United States Patent [19]

Clarke et al.

[11] 4,327,557

[45] May 4, 1982

[54] ADAPTIVE DEFROST CONTROL SYSTEM

[75] Inventors: Clarence C. Clarke; Stephen W. Paddock, both of Evansville, Ind.; Donald E. Knoop, St. Joseph, Mich.

[73] Assignee: Whirlpool Corporation, Benton Harbor, Mich.

[21] Appl. No.: 155,154

[22] Filed: May 30, 1980

[51] Int. Cl.[3] ..... F25D 21/06

[52] U.S. Cl. ..... 62/153; 62/155; 62/234

[58] Field of Search ..... 62/153, 154, 155, 234, 62/157

[56] References Cited

U.S. PATENT DOCUMENTS

| | | | |
|---|---|---|---|
| 2,711,079 | 6/1955 | Grimshaw | 62/153 |
| 2,781,641 | 2/1957 | Foley | 62/153 |
| 3,460,352 | 8/1969 | Lorenz | 62/153 |
| 3,474,638 | 10/1969 | Dodge | 62/153 |
| 3,518,841 | 7/1970 | West, Jr. | 62/153 |
| 3,759,049 | 9/1973 | Bell et al. | 62/80 |
| 3,898,860 | 8/1975 | Shepherd et al. | 62/155 |
| 3,992,895 | 11/1976 | Kramer | 62/155 |
| 4,056,948 | 11/1977 | Goodhouse | 62/155 |
| 4,142,374 | 3/1979 | Ansted et al. | 62/155 |
| 4,156,350 | 5/1979 | Elliott et al. | 62/80 |
| 4,251,988 | 2/1981 | Allard et al. | 62/234 |
| 4,251,999 | 2/1981 | Tanaka | 62/155 |

OTHER PUBLICATIONS

AMF Paragon, "EC20 Series Heat Pump Adaptive Defrost Control", Bulletin 3520, Jan. 29, 1979.

*Primary Examiner*—Albert J. Makay
*Assistant Examiner*—Harry Tanner
*Attorney, Agent, or Firm*—Wegner, McCord, Wood & Dalton

[57] ABSTRACT

A refrigerator includes a compressor, an evaporator fan, a condensor fan and a defrost heater which are controlled by a defrost control system. The control senses the number and duration of freezer and fresh food compartment openings, the duration of the previous defrost operation, and the total accumulated compressor run time since the previous defrosting operation. A stored count is decremented by weighting functions which are adaptably varied in accordance with the number and duration of compartment door openings and the duration of the previous defrosting operation. When the stored count is decremented to zero, the defrosting operation may be initiated, unless inhibited. The defrosting operation is inhibited if the total accumulated compressor run time is less than a predetermined amount. The control is reset to a point just short of a defrosting operation if a power outage occurs.

36 Claims, 10 Drawing Figures

ADAPTIVE DEFROST CONTROL SYSTEM

BACKGROUND OF THE INVENTION

This invention relates to an adaptive defrost control system for use in a temperature controlled device, such as a refrigerator. The adaptive defrost control system utilizes various types of sensed information to control the energization of a defrost heater for de-icing the coils of an evaporator.

It has been recognized that energy consumption and adverse temperature fluctuations within a refrigerated space can be minimized by de-energizing a defrost heater as soon as a frost load has been removed from an evaporator. It is generally desirable to defrost as infrequently as possible, but it is not desirable to allow very large frost loads to develop because they require more time and electrical energy to remove, thus reducing the operating efficiency of the cooling device.

Optimum defrost operation thus requires that a balance be struck between the competing considerations of system operation with a frosted evaporator, the energy consumed in removing a frost load from the evaporator, and the acceptable level of temperature fluctuation caused by a defrosting operation.

In some prior refrigerator defrosting systems, a predetermined number of counts must be accumulated before a defrosting operation is initiated. These counts may be defined as either a cycling of the compressor or as an opening of the refrigerator door while the compressor is operating. However, such a control is not responsive to the duration of door openings, and the number of counts needed to initiate defrost is fixed.

Other types of prior defrost controls have integrated the run time of the compressor and the duration of door openings and initiated the defrost cycle after a fixed cumulative amount has been reached. Alternatively, an electromechanical control has been used to integrate the freezer temperature and the ratio of the compressor on/off time to initiate the defrost cycle. These types of systems rely upon expensive electrical or mechanical components, the first utilizing a coulometer and the second utilizing a combination of thermostatic switches and a thermal time delay relay to perform the integrating function. Moreover, these types of systems do not utilize the previous defrost history, which is an important factor in providing an efficient method of defrosting the evaporator.

Another type of defrost control system combines a relative humidity sensor with either the number of occurrences or the total time duration of cabinet door openings or compressor operation. In each case the combined effect of the refrigerator conditions alters the time interval between defrost cycles. However, this type of defrost system does not utilize both the number and duration of total door openings and the total compressor run time which accumulates between defrost operations.

Other types of defrost systems control the interval between defrosting operations based upon the time required for the defrost heater to raise the evaporator to a predetermined temperature during the previous defrosting operation. The net result of such a system is that the defrost interval will be inversely related to the heater "on" time during the previous defrost operation.

Still another type of defrost control provides a minimum amount of time between defrost operations. This control utilizes a conventional time based defrost timer which is interrupted prior to defrost to allow a demand defrost sensor to take over. The defrost operation is prevented until the sensor indicates that a predetermined frost load has been accumulated.

These and other types of defrost controls suffer from the disadvantages of not taking into account the number and duration of door openings and the previous defrost history.

SUMMARY OF THE INVENTION

In accordance with the present invention, an adaptive defrost control system for a refrigerator or the like utilizes various types of information to control the energization of the defrost heater. The control takes into account the number and duration of freezer and fresh food compartment door openings, the duration of the previous defrosting operation, and the total accumulated compressor run time since the previous defrost operation.

Defrosting is provided at variable intervals as determined by a weighted accumulation of the number and duration of freezer and fresh food door openings, with the weighting functions being adaptably controlled as a function of the time required to perform the previous defrost operation.

The defrosting operation is prevented, regardless of the number and duration of door openings, until a predetermined minimum amount of compressor run time has elapsed.

The control stores a count which is decremented by the weighting functions during a door-open interval. The control checks for minimum compressor run time when the stored count reaches zero to determine whether the defrost indication is due to an excessive number of door openings. Under such a condition, that portion of the control process which varies the weighting functions is disabled. This prevents the control from adapting the next defrost interval due to an abnormal condition, such as excessive door openings.

The count is decremented at different rates depending upon whether the fresh food door or the freezer door is open. Moreover, the count is decremented at a particular rate during a first period of the door-open interval and at a lesser rate thereafter. This feature compensates for the first few seconds of the door-open interval which accounts for a large amount of the frost formed on the evaporator coils.

The control, in the event of a power outage, is reset to a point just short of a defrost operation. This prevents the occurrence of a missed defrost operation which may impair the efficiency or even damage the components of the refrigerator.

The adaptive defrost control system includes a microcomputer which allows the use of a minimum number of hardwired components, thereby reducing space requirements and providing for a relatively inexpensive system. The microcomputer may also perform other functions within the refrigerator, such as controlling the compressor run time and the temperature within the refrigerated compartments.

The control tends to force the length of a defrosting operation to a predetermined desired value. The control compares the length of the previous defrost operation to the desired value and varies the weighting functions in accordance with the comparison. The control does not operate to define a defrost interval which must elapse before the next defrost operation.

The control defrosts the evaporator coils only when necessary; therefore, energy consumption is reduced and temperature performance is improved. The control also adapts to varying conditions of refrigerator use and operating conditions and hence, system efficiency is greatly improved.

Other features of the invention will be apparent from the following description and from the drawings. While an illustrative embodiment of the invention is shown in the drawings and will be described in detail herein, the invention is susceptible of embodiment in many forms and it should be understood that the present disclosure is to be considered as an exemplification of the principles of the invention and it is not intended to limit the invention to the embodiment illustrated.

DESCRIPTION OF THE PREFERRED EMBODIMENT

Figure 1:
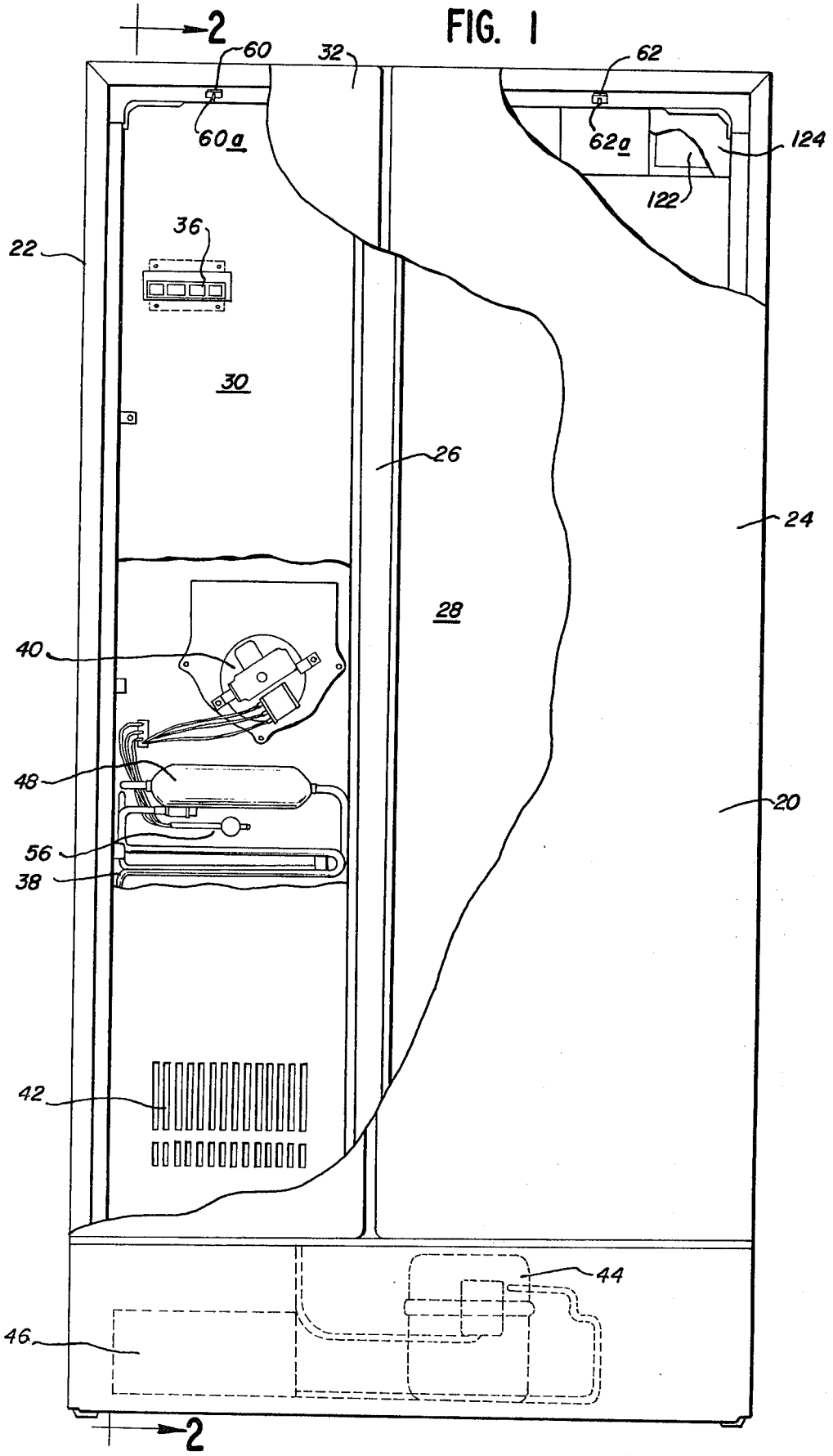
FIG. 1 is a front elevational view of a refrigerator with portions of the freezer door, the fresh food door and the cabinet wall broken away to reveal the components therein.
Figure 2:
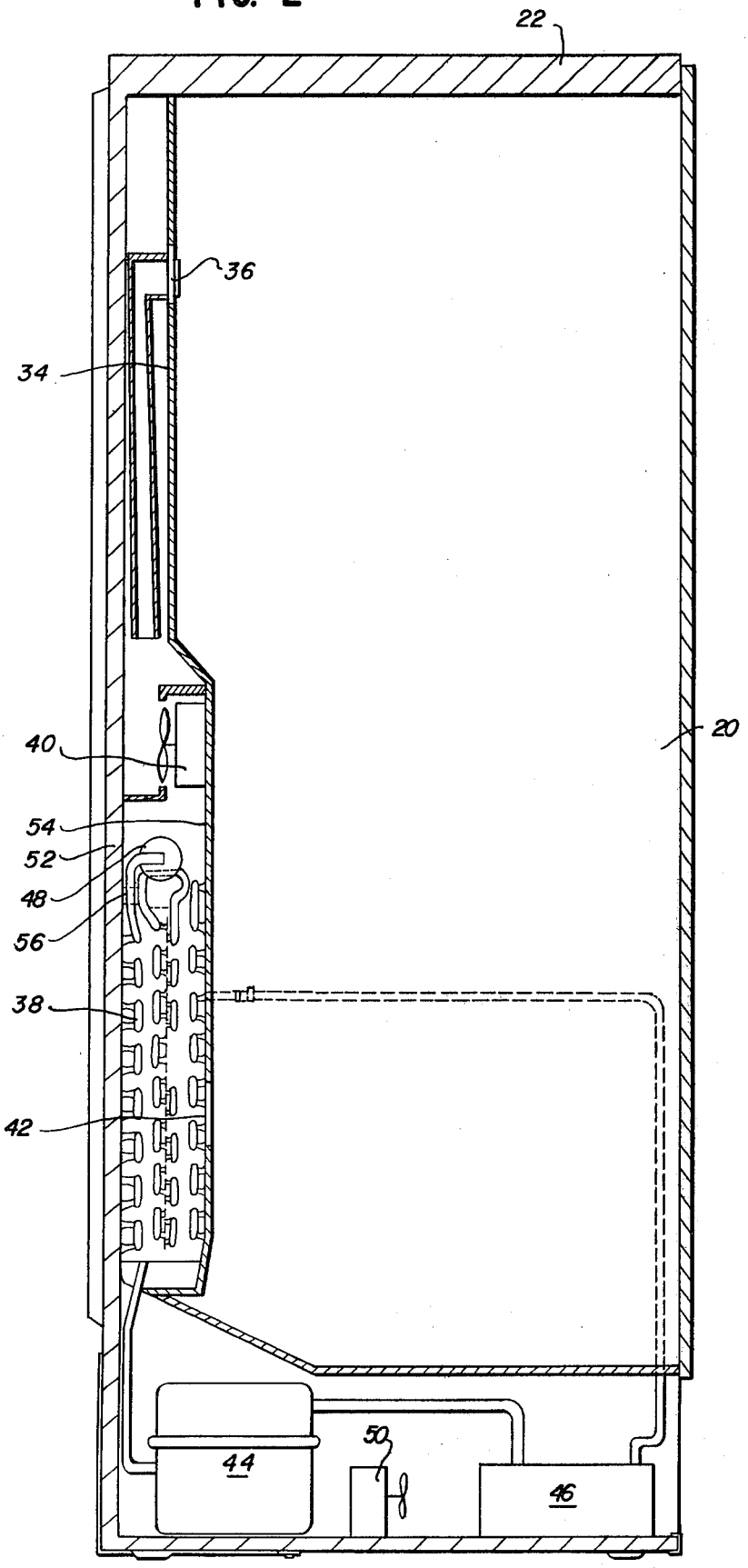
FIG. 2 is a sectional view taken along line 2—2 of FIG. 1.
Figure 3:
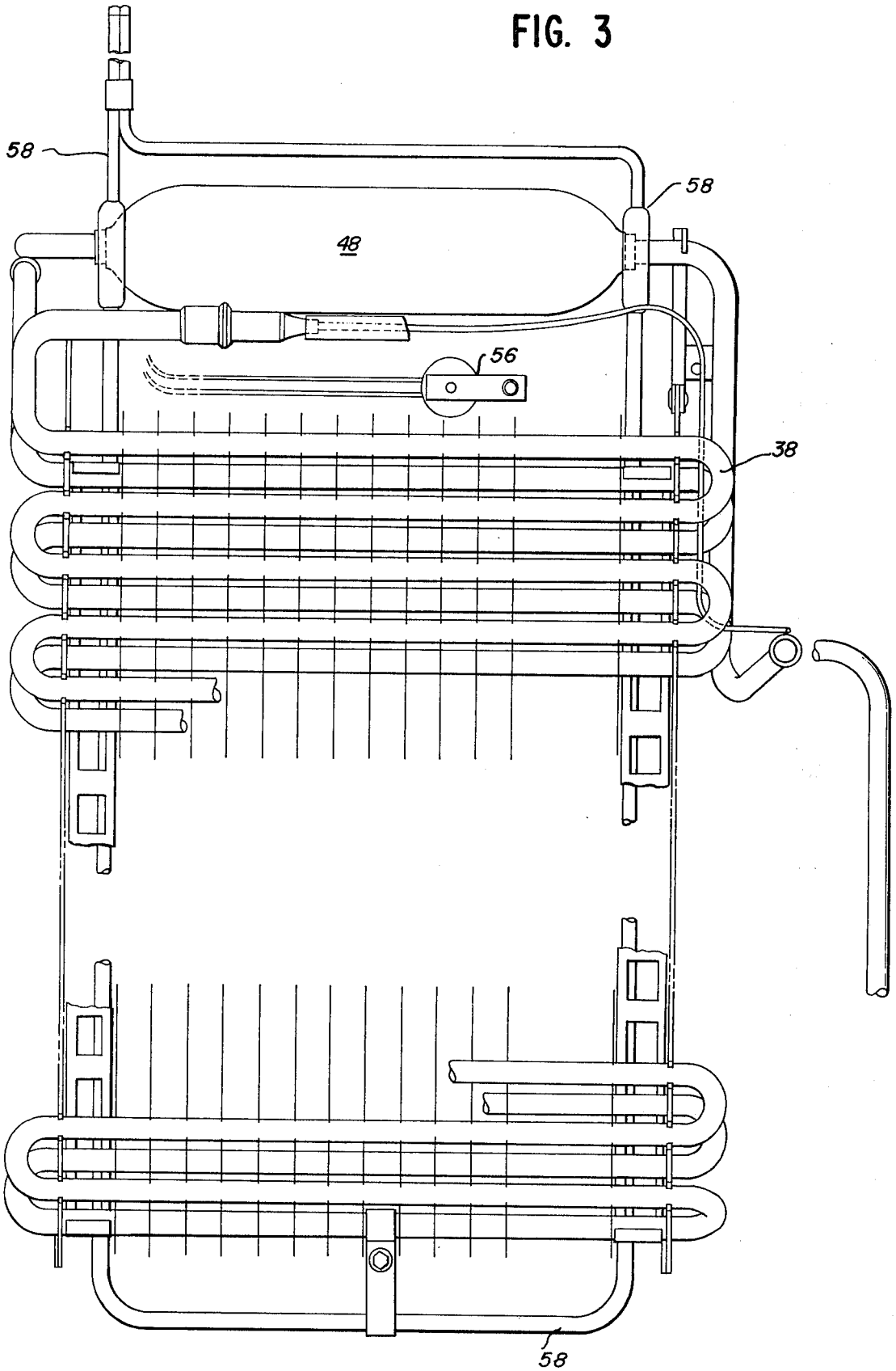
FIG. 3 is an enlarged elevational view of a portion of the evaporator, the defrost heater and the bi-metal sensor utilized by the present invention.

Turning to FIGS. 1, 2 and 3, a conventional refrigerator 20 is illustrated in conjunction with the unique adaptive defrost control system. The refrigerator 20 includes a cabinet 22 which may enclose a plurality of refrigerated compartments, cooled by a forced air refrigeration system. A fresh food compartment door 24 in conjunction with the cabinet 22 and a divider wall 26 enclose a fresh food compartment 28. A freezer compartment 30 is enclosed by the cabinet 22, the divider wall 26, and a freezer door 32. The fresh food and freezer compartments are cooled by passing refrigerated air into the compartments through a discharge air duct 34 and an outlet grill 36, as best seen in FIG. 2.

Air is refrigerated as a result of being passed in heat exchange relationship with an evaporator 38 and is forced by an evaporator fan 40 into the refrigerated compartments 28 and 30. Return air is circulated through an air inlet 42 to the evaporator 38. The refrigeration apparatus includes a conventional compressor 44, condenser 46, and accumulator or header 48, interconnected through tubing to the evaporator 38 to effect the flow of refrigerant thereto. A condenser fan 50 circulates air through the condenser 46, and may be energized concurrently with the compressor 44 and the evaporator fan 40.

The evaporator 38 and the evaporator fan 40 are disposed within an evaporator compartment 52 which is enclosed by the cabinet 22 and a rear wall 54 of the freezer compartment 30. A conventional bi-metal sensor 56 is located adjacent the coils of the evaporator 38 near the header 48. The bi-metal sensor 56 operates to terminate the defrosting operation in a manner to be described.

Disposed between the coils of the evaporator 38 in the form of a defrost heater 58, FIG. 3, which is periodically energized by the adaptive defrost control of the present invention to de-ice the evaporator 38. The defrost heater 58 may be a conventional resistive heater that is energized directly from the a.c. line under the control of a relay or triac.

A freezer door switch 60 having an actuating rocker arm 60*a* and a contact 60*b* is mounted on the cabinet 22 so that the rocker arm 60*a* contacts the closed freezer door 32. A similar fresh food door switch 62 having an actuating rocker arm 62*a* and a contact 62*b* is mounted on the cabinet 22 with the rocker arm 62*a* in contact with the closed fresh food compartment door 24. The rocker arms 60*a* and 62*a* are spring loaded so that when one of the doors 24 or 32 are opened, the corresponding rocker arm 60*a* or 62*a* moves outwardly, out of contact with the corresponding door 24 or 32, thereby causing the contact 60*b* or 62*b* of the switch 60 or 62 to close.

Figure 4:
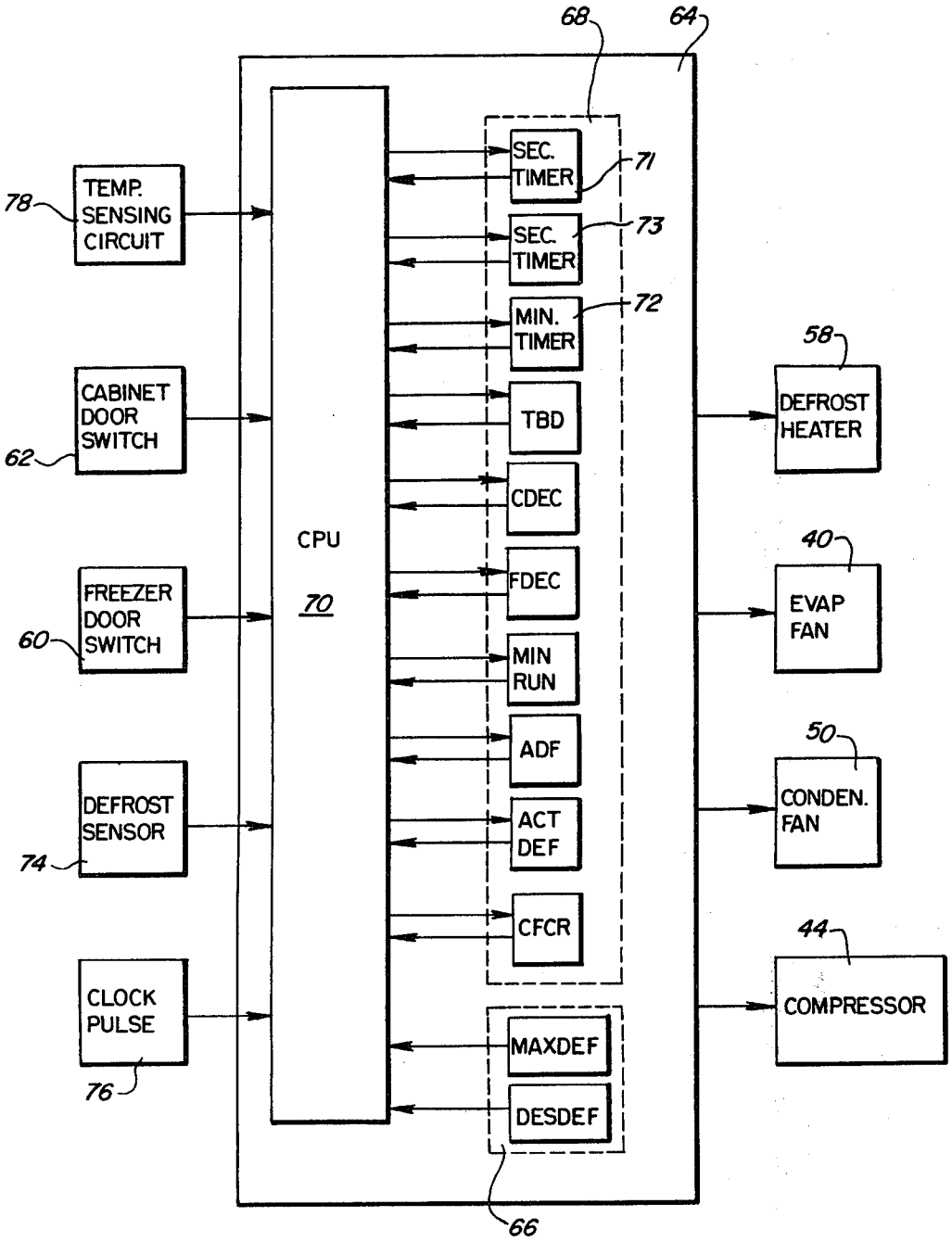
FIG. 4 is a block diagram of the adaptive defrost control system of the present invention.

Referring to FIG. 4, a block diagram of the adaptive defrost control system is illustrated, which may be implemented using digital logic or through the use of a microcomputer. In the preferred embodiment illustrated, a single chip microcomputer 64 is used to implement the defrost control. The microcomputer integrated circuit may be a conventional, singlechip device and may include on the chip, a 1,024×8-bit program read only memory, or ROM 66, and a 64×4-bit scratch pad random access memory, or RAM 68. The microcomputer 64 also contains a central processing unit, or CPU 70 which performs the various computations used in the adaptive control process. The ROM 66 contains the control program, the control logic, and the constants used during control execution. The RAM 68 contains registers which store the several variables used in the control program. Also included in the RAM 68 are a fresh food seconds timer register 71, a freezer seconds timer register 73, and a minute timer register 72. While for purposes of clarity the RAM 68 has been illustrated as containing separate storage registers for each variable, it is to be understood that each storage register may contain the value of several variables over the course of a program execution.

In the illustrated embodiment, microcomputer 64 is implemented by using an American Microsystems, Inc. S2000 Microcomputer which has, in addition to the ROM 66, the RAM 68 and the CPU 70, a switch interface and a seconds timer (not shown) for the 60 Hz. power line which powers the defrost control and the associated components.

The inputs to the microcomputer 64 include the fresh food door switch 62, the freezer door switch 60, a defrost sensor 74, and clock pulse circuitry 76 which controls the internal timing of the microcomputer 64. Another input to the microcomputer 64 is from a temperature sensing circuit 78 which controls the energization of the compressor 44 in accordance with the temperature of the fresh food and freezer compartments 28 and 30.

Outputs from the microcomputer 64 are coupled to energize the defrost heater 58, the evaporator fan 40, the condenser fan 50 and the compressor 44.

The adaptive defrost control system utilizes various data to determine when a defrost operation should be initiated. These data include the number and duration of freezer and fresh food compartment door openings, the duration of the previous defrosting operation, and the total accumulated compressor run time since the previous defrosting operation. The number and duration of compartment door openings are indicated by the door switches 60 and 62 associated with the two compartment doors 24 and 32. The duration of the defrosting operation is determined by monitoring the bi-metal sensor 56 and measuring the amount of time it takes from the start of the defrosting operation until the evaporator 38 reaches a predetermined temperature, such as 55° F., indicating that the frost has been removed.

Defrosting is provided at variable intervals as determined by a weighted accumulation of the number and duration of freezer and fresh food door openings. The microcomputer 64 stores a number or count that must be decremented to zero before a defrost operation is initiated. This count, referred to as TBD (time before a defrost operation is required), is decremented by a first predetermined amount for each second of the first 10 seconds that the freezer door 32 is open, i.e. at a first predetermined rate during the first 10 seconds, and thereafter decremented at a second rate. The TBD count is decremented by a third predetermined amount for each second of the first 10 seconds that the fresh food compartment door 24 is open, i.e. at a second predetermined rate during the first 10 seconds, and thereafter decremented at a fourth rate.

The control weights the first 10 seconds of door opening more heavily than the rest of the "door-open" interval, i.e. the value of the variable TBD is decremented at a certain rate during the first 10 seconds that a door is open, and at a lesser rate thereafter. The amount of frost accumulated during the initial interchange of the dry refrigerated air with the moist ambient air is greater than for following intervals of the same duration. That is, the large temperature difference during the initial 10 seconds causes a rapid interchange of air which results in the forming of a large amount of frost.

The variable TBD is decremented at different rates depending upon whether the fresh food compartment door 24 is open or the freezer compartment door 32 is open. These rates are determined by decrementing values, also referred to as weighting functions and denoted as CDEC and FDEC, respectively, which are varied by an adaptive portion of the control process to force the length of the defrosting operation toward a predetermined desired value, such as 16 minutes. The decrementing values are adaptively varied as a function of the previous defrost history and the duration of the most recent defrost operation. However, the control does not operate to define a defrost interval that must elapse before the next defrost operation. Rather, it is a comparison of the length of a defrost operation to a desired value, not the mere length of the defrost operation itself, that determines the magnitude and direction of change in the weighting functions that are used to determine the interval between defrost operations.

The decrementing values CDEC and FDEC are updated, when necessary, by adding to them an integer multiple of a correction factor CFCR, which is derived by comparing the actual defrost time, denoted ACTDEF, with a desired defrost time DESDEF. The particular integer multiple used depends upon the decrementing values being updated. In general, CFCR is multiplied by 3 when updating CDEC, and by 4 when updating FDEC.

Normally, once the number TBD has been decremented to zero, the defrost heater 58 is energized. However, inhibiting means (and a compressor timer) are provided for preventing the initiation of a defrost operation if TBD reaches zero before a predetermined minimum amount of compressor operating time has been accumulated. The control checks for minimum compressor run time when TBD reaches zero to determine whether the defrost indication is due to an excessive number of door openings. Under this condition, the adaptive portion of the control process is disabled. As the adaptive defrost control takes into account the previous history of the defrosting operations, it is desirable to prevent the control from adaptively varying the decrementing of the values CDEC and FDEC due to an abnormal condition, such as excessive door openings.

The defrost control is reset by the control logic to initiate defrost shortly after a power interruption. The control utilizes a volatile storage system which loses all storage data if a power interruption occurs. Therefore, if a power interruption occurs immediately before defrost is to be initiated, the loss of data could cause a missed defrost operation. Depending upon ambient conditions, several missed defrosts could cause failure of the system. Consequently, this feature ensures that a defrost operation will take place within a relatively short time after a power interruption.

Figure 5:
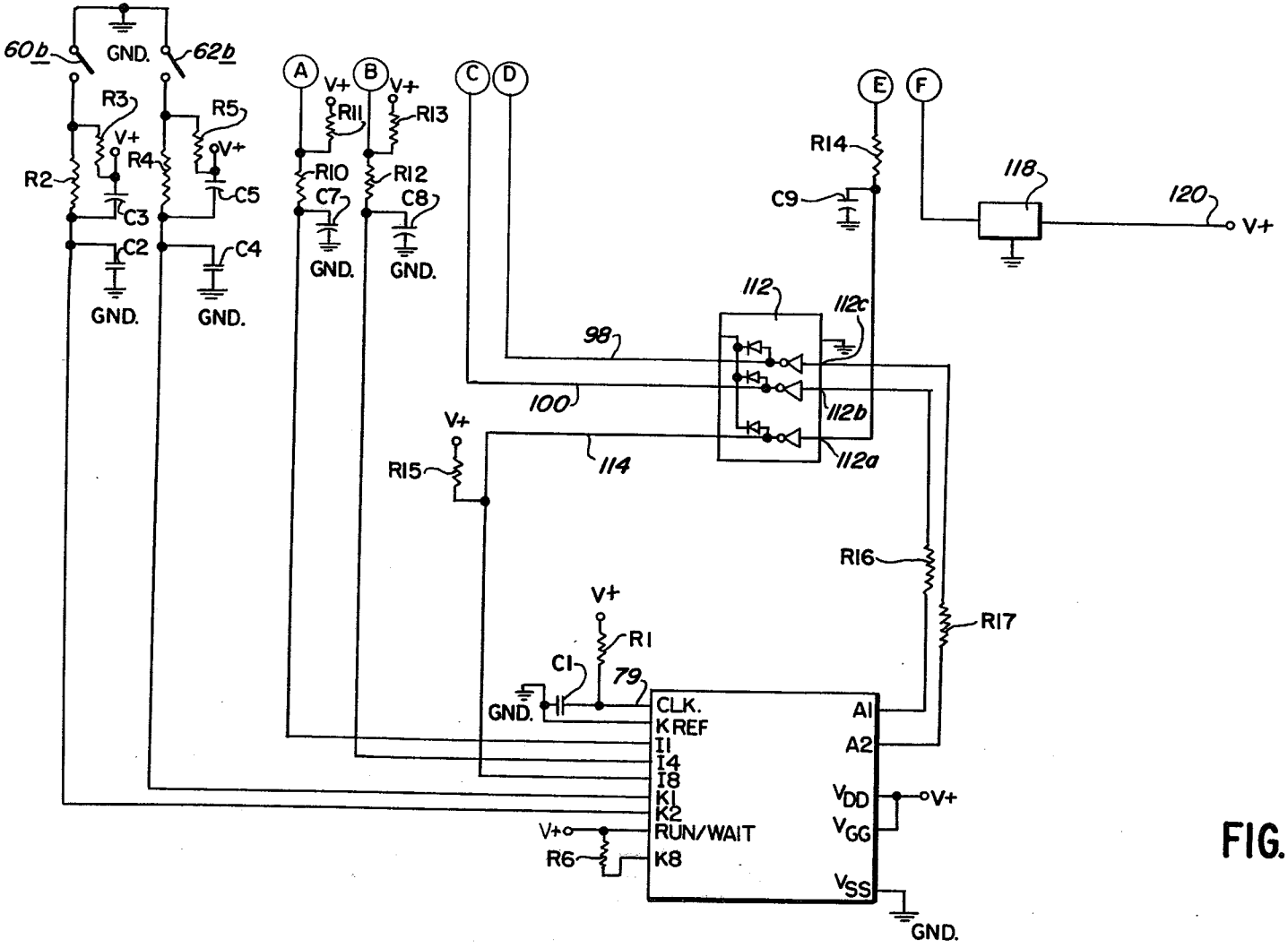
FIG. 5 is a partial schematic diagram of the control logic shown in block form in FIG. 4.
Figure 6:
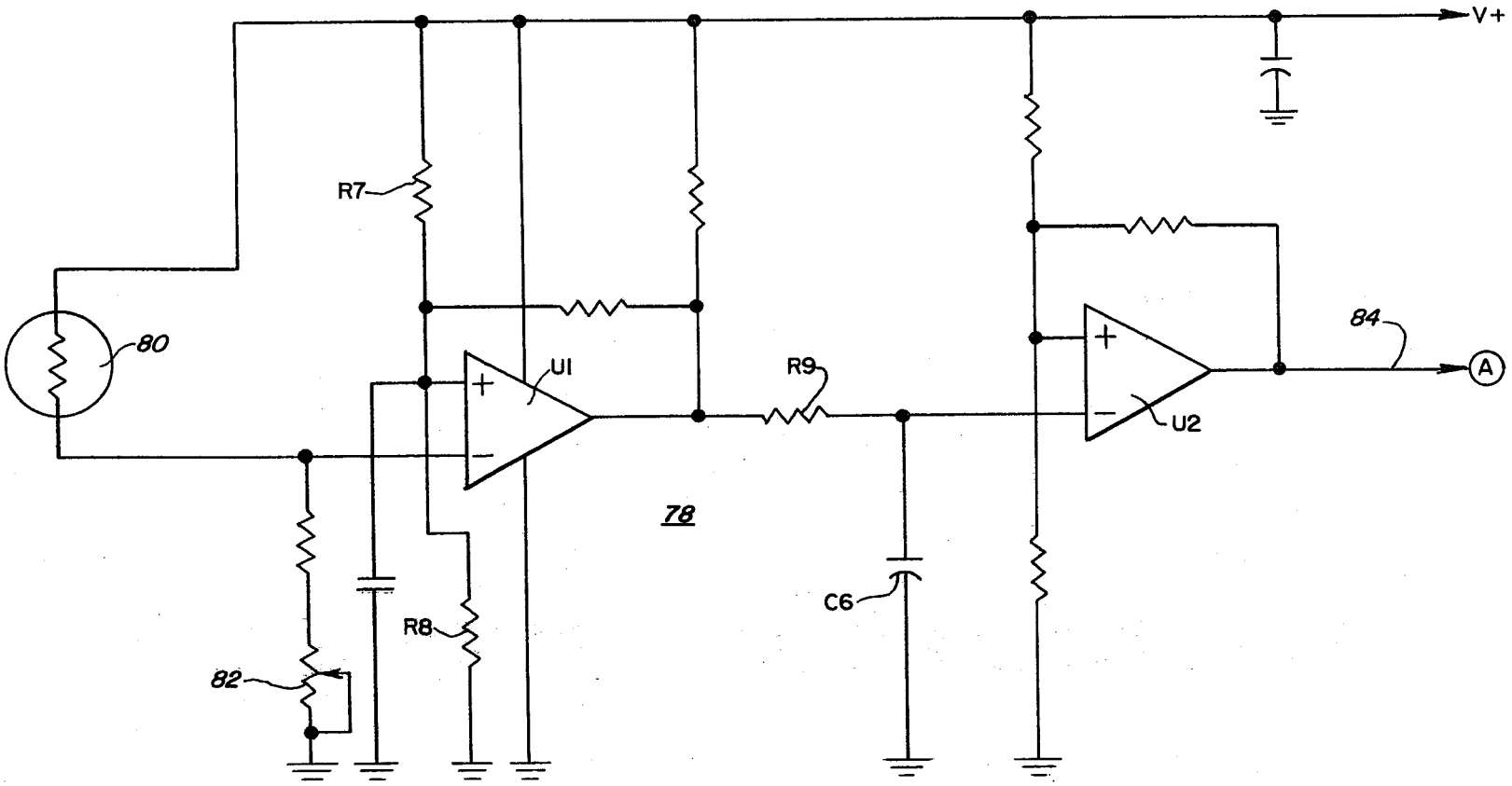
FIG. 6 is a schematic diagram of the temperature sensing circuit of the control logic shown in block form in FIG. 4.
Figure 7:
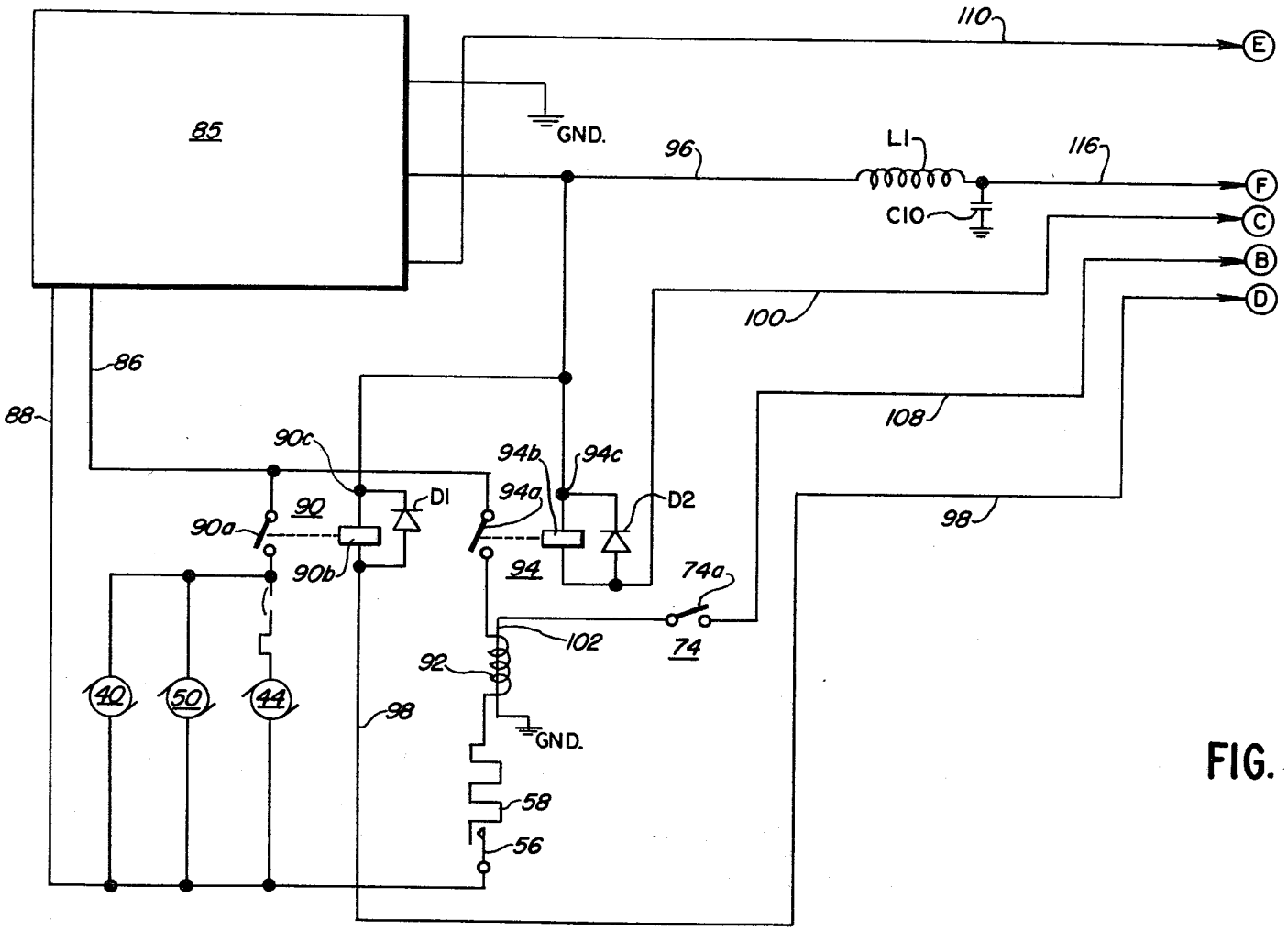
FIG. 7 is a schematic diagram of the evaporator fan, condenser fan, and compressor circuits of the adaptive defrost control system of the present invention.

In FIGS. 5, 6 and 7, the circuit of the adaptive defrost control system shown in block form in FIG. 4, is illustrated in detail. Two power supply inputs $V_{GG}$ and $V_{DD}$ for the microcomputer 64, FIG. 5, are both connected to a source of supply potential V+, which illustratively may supply 8.5 volts to the microcomputer 64. Another power supply input $V_{SS}$ is connected to ground potential GND.

A clock input CLK is connected to the source of ground potential GND through a capacitor C1 and a line 79. The line 79 is also connected to the supply voltage V+ through a resistor R1. The resistor R1 and the capacitor C1 form the clock pulse circuitry 76 for the internal clock of the microcomputer 64.

The door-open interval information is inputted to the microcomputer 64 over two input lines K1 and K2. The contact **60*b* of the freezer door switch 60 is connected to the input K2 through a resistor R2 and to supply potential V+ through a resistor R3. Similarly, the contact 62*b* of the fresh food door switch 62 is connected to the input K1 through a resistor R4 and to voltage supply V+ through a resistor R5. The opposite terminals of both switches are connected together and to the source of ground potential GND. The input K2 is also connected to ground potential GND through a capacitor C2 and to voltage supply V+ through a capacitor C3. Input K1 is connected to GND through a capacitor C4 and to V+ through a capacitor C5**.

The determination of whether a door is open is made by comparing the voltage on input lines K1 and K2 to a reference voltage which is inputted to a Kref input of the microcomputer 64. In the preferred embodiment, the voltage on the Kref input is zero volts. If the switch contact controlled by the rocker arm **60*a* or 62*a* corresponding to the input K2 or K1 is open, a signal is detected on one of these K lines by comparing the voltage on the line to a voltage on the Kref input. If the contact 60*b* or 62*b*** associated with the particular "K" line is closed, a low state signal is detected by comparison with the voltage on the Kref input.

A run/wait control input is connected to supply potential V+. Another "K" line input K8 is connected to supply potential V+ through a resistor R6.

Two additional data inputs I1 and I4, described hereinafter, monitor the compressor 44 run time and the defrost heater 58 operating time, respectively.

Referring specifically to FIG. 6, there is illustrated the temperature sensing circuit 78 which periodically sends a trigger signal to the microcomputer 64 to energize the compressor 44 in response to the difference between the temperature within the refrigerator and a desired temperature, or "set point". For a detailed description of the operation of the temperature sensing circuitry 78, reference should be made to the copending application of Stephen Paddock and Andrew Tershak, Ser. No. 68,473, filed Aug. 20, 1979, owned by the assignee of this application, and entitled "Temperature Sensing Circuit with High Noise Immunity". Briefly, when the temperature sensed by a thermistor 80 rises above the set point as determined by a potentiometer 82 and a voltage divider network consisting of resistors R7 and R8, the output of a comparator U1 will change to a low state, indicating that cooling is required. This low state signal is sent to the input of a comparator U2 through an RC circuit consisting of a resistor R9 and a capacitor C6 which causes the output of U2 to assume a high state.

Conversely, when the temperature sensed by the thermistor 80 is below the set point, the output of the comparator U1 assumes a high state which is coupled to the input of U2 through the RC network consisting of the resistor R9 and the capacitor C6. The high state input causes the output of the comparator U2 to assume a low state.

The output of comparator U2 is sent over a line 84 to the input I1, FIG. 5, through a resistor R10. The line 84 is also connected to the voltage supply V+ through a resistor R11 and the input I1 is connected to GND through a capacitor C7.

Referring to FIG. 7, the fan, compressor and heater circuits are illustrated in detail. A transformer and rectifying circuit 85 provides suitable voltages for the various components of the control. A regulated a.c. line voltage of approximately 120 volts is provided between a line 86 and a ground line 88 to the evaporator fan 40, the condensor fan 50 and the compressor 44 through a relay contact 90*a* of a relay 90. The contact 90*a* is a normally open contact which is closed by an associated actuating coil 90*b*. A diode D1, connected across the actuating coil 90*b*, dissipates the back emf generated by the coil 90*b* when it is switched from an energized to a deenergized state.

Also connected between the line 86 and the ground line 88 are the defrost heater 58, the bi-metal sensor 56, a sensing coil 92, and a movable contact 94*a* of a relay 94. The movable contact 94*a* is a normally open contact which is closed by an actuating coil 94*b* having a diode D2 connected thereacross to dissipate the back emf of the coil.

The actuating coils 90*b* and 94*b* each have a terminal 90*c* and 94*c*, respectively, connected to a line 96 which has a fully rectified d.c. voltage of 15 volts impressed thereon. The other terminals of actuating coils 90*b* and 94*b* are connected via lines 98 and 100, respectively, to other components of the control.

Running through the sensing coil 92 is a sensing line 102 which is connected at one end to the defrost sensor 74, which may be a reed switch, and at its other end to ground potential GND. The reed switch defrost sensor 74 has a normally open movable contact 74*a* which closes in response to current flowing through the sensing coil 92. The other end of the defrost sensor 74 is connected by a line 108 to an input I4, FIG. 5, of the microcomputer 64 through a resistor R12. The line 108 is connected to supply voltage V+ through a resistor R13. The input I4 is connected to ground potential GND through a capacitor C8.

The transformer and rectifying circuit 85, FIG. 7, also provides a half-wave rectified output of 60 Hz. over line 110 to an input 112*a* of a driver circuit 112 through a resistor R14, FIG. 5. The input 112*a* is connected to ground potential GND through a capacitor C9. The driver circuit 112 amplifies the voltage appearing at the input 112*a* and sends the output over a line 114 to an input I8 of the microcomputer 64. The line 114 is connected to supply potential V+ through a resistor R15. The half-wave rectified voltage appearing at input I8 is utilized by the seconds timer (not shown) of the microcomputer 64.

The unfiltered rectified 15 volt output on line 96 is filtered by an LC circuit composed of an inductor L1 and a capacitor C10 and is sent over a line 116 to a regulating circuit 118. The output of the regulating circuit 118 is sent over line 120 to the various parts of the control as supply potential V+, illustratively equal to +8.5 volts.

A control output A1 of the microcomputer 64 is connected to an input 112*b* of the driver circuit 112 through a resistor R16. The driver 112 acts to isolate the microcomputer 64 from the balance of the circuit. The voltage appearing at the input 112*b* is amplified and is sent over the line 100 to the actuating coil 94*b* of the relay 94, FIG. 7.

Another control output A2 is connected through a resistor R17 to an input 112*c* of the driver circuit 112. The driver circuit 112 amplifies the voltage appearing at input 112*c* and sends the amplified voltage over the line 98 to the terminal of the actuating coil 90*b* of the relay 90.

The control circuitry illustrated in FIGS. 5 and 6, except the door switches 60 and 62, may be mounted on a circuit board 122 which in turn may be mounted behind a control panel 124 located in one of the refrigerated compartments, FIG. 1.

Figure 8A:
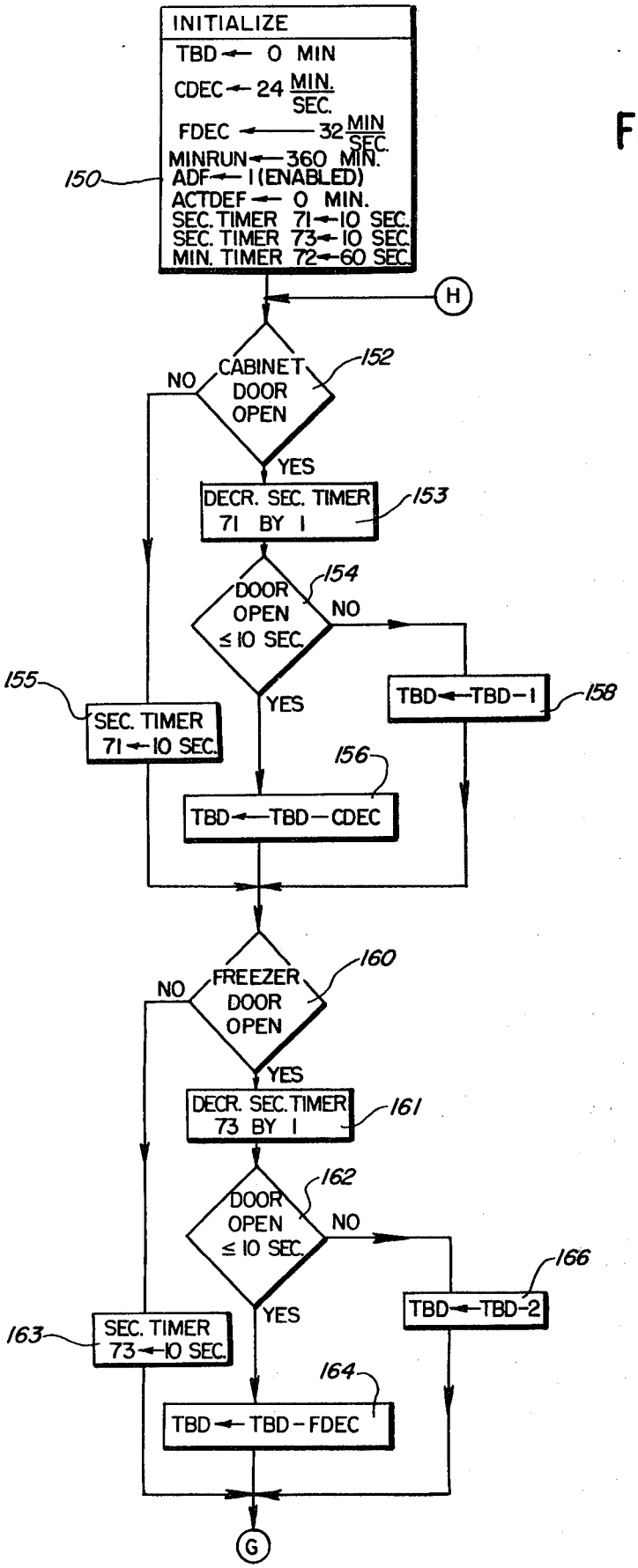
FIGS. 8*a*, 8*b* and 8*c*, comprise a single flow chart of the control program contained in the control logic.
Figure 8B:
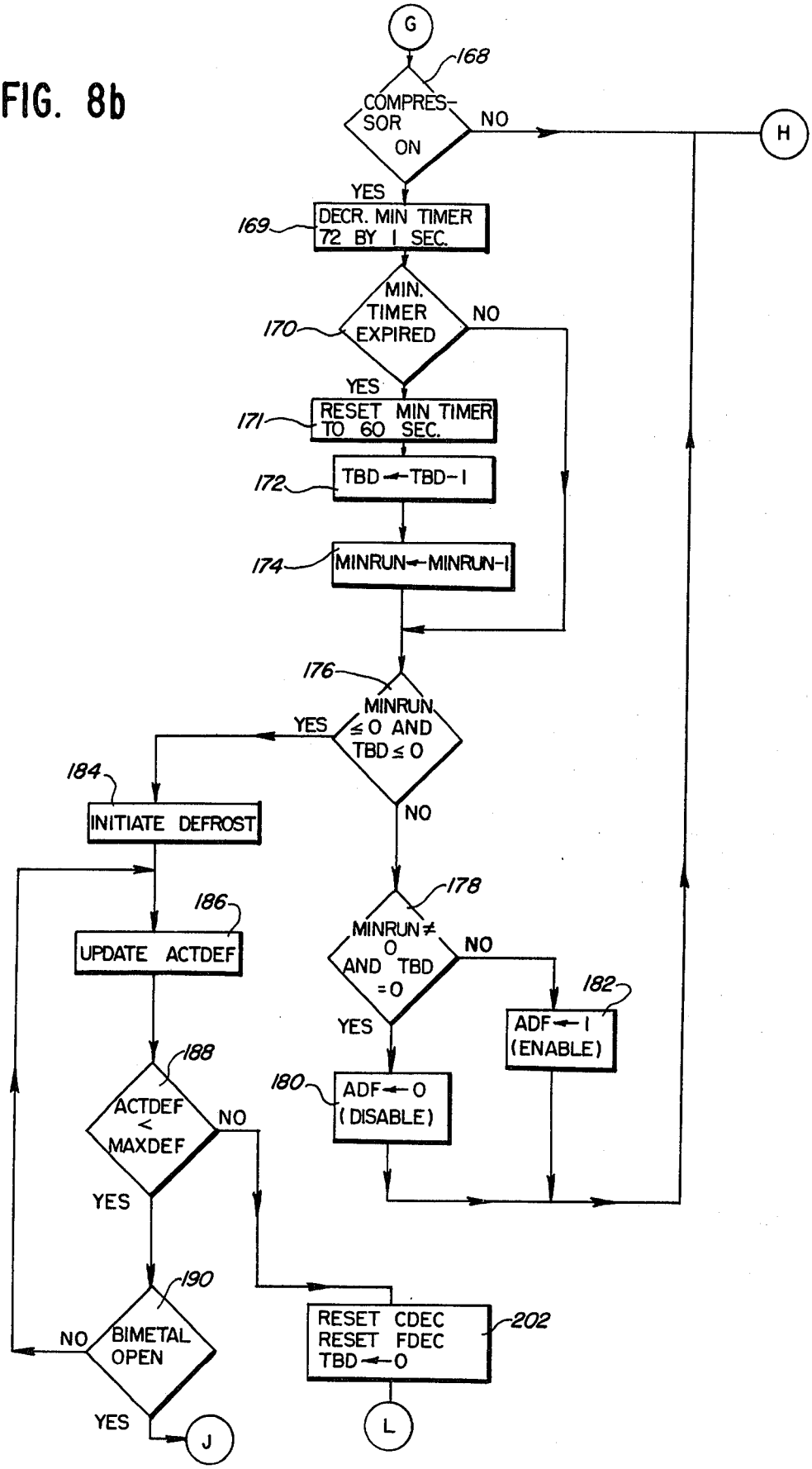
Figure 8C:
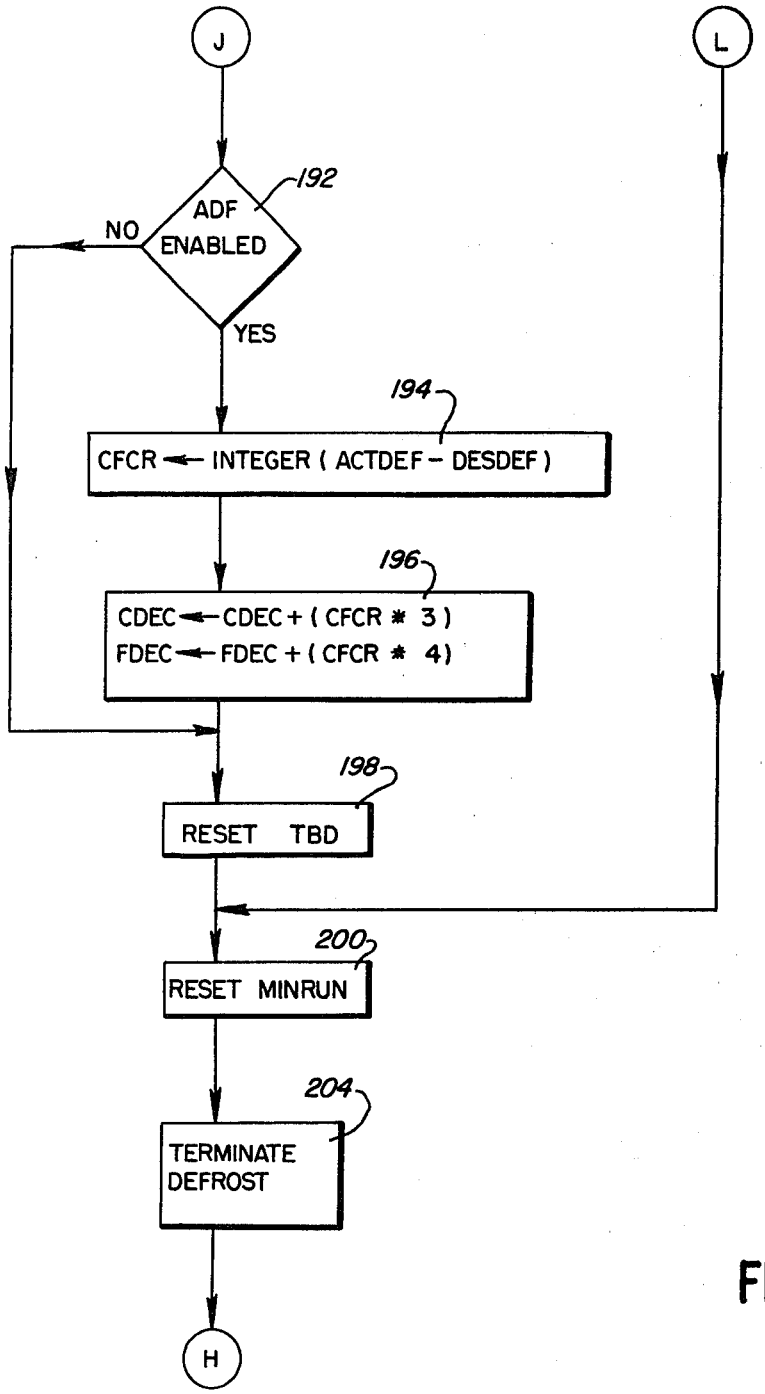

Referring now to FIGS. 8*a*–8*c*, the control program of the adaptive defrost control system will be described. The program cycle is executed once each second to continuously update the system condition.

A block 150, FIG. 8*a*, initializes the variables used in the control program. The time before defrost count stored in the TBD register is assigned a value of zero minutes. The value stored in the CDEC register, which represents the number of minutes TBD is decremented each second during the first 10 seconds of fresh food door opening, is assigned a value of 24 minutes per second. The value stored in the FDEC register, which represents the number of minutes TBD is decremented each second during the first 10 seconds of freezer door opening, is assigned a value of 32 minutes per second. A MINRUN register, the value of which represents the minimum amount of compressor run time before a defrost can be initiated, is assigned a value of 360 minutes or 6 hours. An adaptive defrost enable flag ADF is enabled by assigning to it a value of 1. An ACTDEF register, the value of which represents the actual length of defrost time is assigned a value of zero minutes. The seconds timer registers 71 and 73 are assigned a value of 10 seconds and the minute timer register 72 is set equal to 60 seconds.

A decision block 152 then determines whether the fresh food door is open. The block 152 senses the input K1 of the microcomputer 64 and determines whether a low state signal is present thereon, indicating that the fresh food compartment door 24 is open. If affirmative, then the seconds timer 71 is decremented by 1 second by a block 153 and control passes to a decision block 154.

The decision block 154 determines whether the fresh food compartment door 24 has been opened for less than or equal to 10 seconds. This is accomplished by the block 154 reading the contents of the seconds timer register 71. If the block 154 determines that the contents of the seconds timer register 71 is greater than zero, then a block 156 decrements the value of TBD (i.e. the count) by the current value stored in the CDEC register.

If the block 154 had determined that the fresh food compartment door was open for greater than 10 seconds, i.e. the contents of the seconds register was less than or equal to zero, then block 158 would have decremented the value of TBD by 1. Control from the blocks 156 and 158 passes directly to a decision block 160.

If block 152 determined that the fresh food door 24 was closed, control would pass to a block 155 which would reset the seconds timer register 71 to 10 seconds. Control from the block 155 advances to the decision block 160.

The decision block 160 determines whether the freezer door is open by monitoring the input K2 of the microcomputer 64 with the same steps as were performed by the block 152. If the block 160 determines that the freezer door is open, then a block 161 decrements the value stored in the freezer seconds timer by one. A decision block 162 then determines whether the door has been open less than or equal to 10 seconds. If this is the case, a block 164 decrements TBD by FDEC. If such is not the case, a block 166 decrements TBD by 2. Control from block 164 and 166 shifts to a decision block 168.

If block 160 determines that the freezer door is not open, then a block 163 resets the freezer seconds timer register 73 to 10 seconds. Control then shifts to the decision block 168.

The decision block 168, FIG. 8*b*, determines whether the compressor is on. This is performed by monitoring the input I1 of the microcomputer, FIG. 5, to determine whether it carries a high state signal. This high state signal is sent by the temperature sensing circuit 78 to indicate that cooling is required and to instruct the microcomputer 64 to energize the compressor 44. If cooling is required, then a high state signal is sent from the output A2 to the line 98 to energize the actuating coil 90*b*, FIG. 7, of relay 90 which closes the movable contact 90*a*. The compressor 44 is then energized along with the condenser fan 50 and the evaporator fan 40.

If the decision block 168 terminates that the compressor is on, then the minute timer 72 is decremented by one second by a block 169. Then a decision block 170 determines whether the minute timer 72 has expired, i.e. is equal to zero. If this is the case, then a block 171 resets the value stored in the minute timer 72 to 60 seconds. A block 172 then decrements the contents of the register TBD by one and a block 174 decrements the value stored in the MINRUN register by one. Control from block 174 and from block 170, in the even that the minute timer has not expired, passes to a decision block 176.

If the decision block 168 determines that the compressor is not on, control shifts back to the block 152 to begin another program execution.

The decision block 176 determines whether the contents of the MINRUN and TBD registers are less than or equal to zero. If the values stored in either the MINRUN or TBD registers are greater than zero, then control passes to another decision block 178 which tests to determine whether the MINRUN value is not equal to zero and TBD is equal to zero. If the determination is affirmative, then TBD has been decremented to zero before the minimum amount of compressor 44 run time has accumulated because of an excessive number of door openings. Therefore, control shifts to a block 180 which assigns a value of zero to the adaptive defrost enable flag ADF, thereby disabling an adaptive portion of the defrost control process, which is described below.

If the determination made in block 178 is negative, a block 182 assigns a value of 1 to the adaptive defrost enable flag, thereby enabling the adaptive portion of the control program. Control from the blocks 180 and 182 passes directly back to the decision block 152 to continue the control program.

If the decision block 176 decides that MINRUN is less than or equal to zero and that TBD is less than or equal to zero, a block 184 initiates defrosting of the evaporator coils by enabling output A2 in FIG. 5. The output A2 deenergizes the line 98, FIG. 7, causing the actuating coil 90*b* of relay 90 to open the movable contacts 90*a*. When the movable contact 90*a* is open, the evaporator fan 40, the condensor fan 50 and the compressor 44 are de-energized.

Next, the output A1 of the microcomputer 64, FIG. 5, is energized by the block 184, thereby energizing the line 100 and hence the actuating coil 94*b* of relay 94, FIG. 7. The energization of the actuating coil 94*b* causes the movable contact 94*a* to close. Because the evaporator 38 is at a low temperature, the bi-metal sensor 56 is bent into contact with the defrost heater 58, thereby completing a circuit through the movable contact 94*a*, the sensing coil 92, the defrost heater 58 and the bi-metal sensor 56. The defrost heater 58 is consequently energized by the lines 86 and 88 and begins to raise the temperature of the evaporator coils 38. Once the block 184 has initiated defrost, control shifts to a block 186.

The block 186, FIG. 8*b*, monitors the minute timer 72 and assigns the actual length of time the defrost heater 58 has been energized to the ACTDEF register. A decision block 188 then determines whether the value stored in the ACTDEF register is less than a constant value, denoted MAXDEF, which represents the maximum allowable defrost time. The value of MAXDEF is stored in the ROM 66 and in the preferred embodiment is set equal to 21 minutes.

If the decision block 188 determines that the value stored in the ACTDEF register is less than the MAXDEF value, then a decision block 190 determines whether the bi-metal sensor 56 has moved out of contact with the defrost heater 58, indicating that the evaporator 38 has been warmed sufficiently to remove the frost load. If current is flowing through the sensing coil 92, indicating that the movable contact 94a is closed and that the bi-metal sensor 56 is in contact with the defrost heater 58, the contact 74a of the reed switch defrost sensor 74 will also be closed. The closed condition of the contact 74a of the defrost reed switch sensor 74 causes a low state signal to appear at the input I4 of the microcomputer 64. Consequently, if a low state signal is detected at the input I4 by the block 190, the bi-metal sensor 56 is not open and hence control passes back to the block 186 which updates the value of ACTDEF.

If, however, a high state signal is detected at the input I4, the bi-metal sensor 56 is in an open state and control passes to a decision block 192, FIG. 8c, which determines if the adaptive defrost enable flag ADF is enabled. If the value of ADF is equal to 1, then a block 194 subtracts the value of a constant DESDEF, stored in the ROM 66 and which represents the desired length of time to perform a defrost operation, from the value of ACTDEF and assigns the integer portion of the result to the correction factor register CFCR. The constant DESDEF, in the preferred embodiment, is set equal to 16 minutes.

A block 196 in conjunction with the block 194, FIG. 8c, comprise the adaptive portion of the control program. The block 196 updates the decrementing values stored in the registers CDEC and FDEC by adding to them an integer multiple of the value stored in the register CFCR. As previously mentioned, the value stored in the CDEC register is updated by adding to it the current correction factor value stored in the CFCR register multiplied by 3. The decrementing value stored in the FDEC register is updated by adding to it the current correction factor value stored in the CFCR register multiplied by 4.

The adaptive portion of the control process varies the values stored in the CDEC and FDEC registers so as to take into account the previous defrost history. When an integer multiple of the correction factor CFCR is added to the values of CDEC and FDEC, the count will be decremented during the next defrost interval by a greater or lesser amount when a compartment door is open. Whether the count is decremented by a greater or lesser amount depends upon the length of the immediately preceding defrost operation, as compared to the desired defrost operation duration DESDEF. Generally, if the value stored in the ACTDEF register is less than the value of DESDEF, then the values stored in the CDEC and FDEC registers will be made smaller resulting in a larger accumulated frost load than before on the evaporator 38, which in turn requires a longer defrost operation to remove.

Alternatively, if the value of ACTDEF is greater than the value of DESDEF, the values stored in the CDEC and FDEC registers will be made larger, resulting in a smaller frost load accumulation than before. This condition results in a shorter defrost operation duration for the next defrost operation.

Consequently, the adaptive portion of the control process tends to force the duration of the defrost operation towards the predetermined optimum duration DESDEF by taking into account the previous defrost history.

A block 198, FIG. 8c, then assigns the value of 8,640 minutes to the variable TBD. Control passes directly to the block 198 if the decision block 192 determines that the variable ADF is equal to zero. Control after block 198 then shifts to a block 200.

If the decision block 188 determines that the actual defrost time ACTDEF is equal to or has exceeded the maximum defrost time MAXDEF, then control shifts to a block 202 which resets the decrementing variables CDEC and FDEC to their initialized values and assigns a value of zero minutes to the variable TBD. It should be noted that this assignment of values will cause the next defrost operation to take place as soon as the minimum compressor 44 run time MINRUN has elapsed.

Control from the block 202 shifts directly to the block 200 which resets the value of MINRUN to the initialized value of 360 minutes. A block 204 then terminates the defrost operation by de-energizing the output A1, causing the line 100 and the actuating coil 94b to become de-energized. This causes the movable contact 94a to open, thereby removing the source of electrical power supplied through lines 86 and 88 from the defrost heater 58. The evaporator fan 40, the condenser fan 50 and the compressor 44 may then be energized by the output A2 if the temperature sensing circuit 78 so indicates.

Control from the block 204 then shifts back to the block 152, FIG. 8a, to begin another program execution.

It should be noted that should a power outage occur, the control program upon power resumption will initiate a defrost operation after 360 minutes of compressor 44 operation. This is due to the particular assignment of values made by the block 150, FIG. 8a, which assigns a value of zero minutes to the TBD register and 360 minutes to the MINRUN register immediately following power restoration.

Some or all of the concepts embodied in the present invention may be implemented through the use of discrete components, such as counters, digital logic components, or the like.

We claim:

1. In a cooling system having a defrost device and cooled compartment accessible through a door, a defrost control for energizing the defrost device, comprising:

door sensing means for detecting an initial open period for said door and a subsequent open period when said door remains open beyond said initial open period;

control means for energizing said defrost device at the end of an interval determined at least partly by the cumulative open period of the door, including:

first advance means for advancing toward the end of the interval at a first rate in response to the initial open period to compensate for increased frost occurring during the initial door open period, and second advance means for advancing toward the end of the interval at a second rate less than said first rate in response to the subsequent open period to compensate for lesser frost occurring during the subsequent open period.

2. The defrost control of claim 1, wherein said control means includes storage means for storing a numerical value representing the beginning of said interval.

3. The defrost control of claim 2, wherein said first and second advance means further include changing means for changing said numerical value into a succession of intermediate values to advance toward the end of said interval.

4. The defrost control of claim 3, wherein said control means further includes energizing means coupled to said storage means for energizing said defrost device when said numerical value is changed into a predetermined final value representing the end of said interval.

5. The cooling system of claim 1, wherein said cooling system includes a compressor, said defrost control further including compressor timing means for indicating the run time of said compressor, said control means including inhibiting means for inhibiting energization of said defrost device until said run time reaches a predetermined minimum amount.

6. The defrost control of claim 5, wherein said defrost control is actuated by a source of power, said control means including override energizing means operative following power actuation for energizing said defrost device when said run time reaches said predetermined amount.

7. In a cooling system having a defrost device and a cooled compartment accessible through a door, a defrost control for energizing said defrost device, comprising:

door timing means for measuring the duration of time said door is open, cycle means for energizing said defrost device at the end of a variable defrost interval dependent partly upon the measured door open time, de-energization means for ceasing energization of said defrost device after determining that a frost load has been removed, defrost timing means for measuring the period of time said defrost device has been energized, and adaptive means for varying the manner in which the defrost interval is determined by the measured door open time in response to the time period measured by the defrost timing means.

8. The defrost control of claim 7, wherein said defrost control includes storage means for storing an initial value, and changing means for changing said initial value into a succession of intermediate values and a final value representing the end of said variable defrost interval.

9. The defrost control of claim 8, wherein said door timing means includes detecting means for detecting an initial open period for said door and a subsequent open period when said door remains open beyond said initial open period.

10. The defrost control of claim 9, wherein said changing means includes means for changing said initial or intermediate value at a first rate in response to said detected initial open period, and said changing means further includes means for changing an intermediate value at a second rate in response to said detected subsequent open period.

11. The defrost control of claim 10, wherein said adaptive means includes comparison means for comparing said measured time period against a desired time period to obtain a correction factor.

12. The defrost control of claim 11, wherein said adaptive means includes varying means for varying said first rate in response to said correction factor to change the magnitude of a subsequent correction factor obtained by a comparison of a subsequent measured time period and said desired time period.

13. The defrost control of claim 7, wherein said cooling system further includes a compressor, said energization cycle means including compressor timing means for measuring the run time of said compressor, and inhibiting means for preventing energization of said defrost device until said run time reaches a predetermined duration.

14. The defrost control of claim 13, wherein said defrost control is energized by a source of power, said defrost control including override means for energizing said defrost device when said run time reaches said predetermined duration immediately following power energization.

15. In a cooling device having a defrost device and a cooled compartment accessible through a door, a defrost control for energizing the defrost device, comprising:

door sensing means coupled to said door for indicating when said door is open;

door timing means coupled to said door sensing means for detecting an initial open period for said door and a subsequent open period when said door remains open beyond said initial open period;

storage means for storing a count;

adjust means coupled to said storage means and responsive to said door timing means for varying said count at an adaptably variable rate when said initial open period is detected, said adjust means including fixed means for varying said count at a predetermined rate when said subsequent open period is detected; and control means for actuating said evaporator defrost device to energize said defrost device when said count reaches a predetermined numerical value.

16. The defrost control system of claim 15, wherein said defrost device includes temperature control means for de-energizing said defrost device after a variable length of time, and a defrost timer coupled to said defrost device for measuring the length of time said defrost device is energized to obtain a defrost operation duration.

17. The defrost control system of claim 16, wherein said adjust means includes comparison means coupled to said defrost timer for comparing said duration of said defrost operation against a desired defrost operation duration, and adaptive means for varying said adaptably variable rate in accordance with said comparison.

18. The defrost control system of claim 15, wherein the temperature controlling device further includes a compressor and compressor timing means for indicating the run time of the compressor while said count is being varied.

19. The defrost control system of claim 18, wherein said control means further includes inhibiting means for inhibiting said defrost operation until said compressor run time reaches a minimum duration.

20. The defrost control system of claim 19, wherein said defrost device includes temperature control means for deenergizing said defrost device after a variable length of time, and a defrost timer coupled to said defrost device for measuring the length of time said defrost device is energized to obtain a defrost operation duration.

21. The defrost control system of claim 20, wherein said adjust means includes comparison means coupled to said defrost timer for comparing said duration of said defrost operation against a desired defrost operation duration, and adaptive means for varying said adaptably variable rate in accordance with said comparison.

22. The defrost control system of claim 21, wherein said inhibiting means includes adaptive disable means for disabling said comparison means and said adaptive means when said defrost operation is inhibited, said inhibiting means further including adaptive enable means for enabling said comparison means and said adaptive means when said compressor run time reaches said minimum duration before said count reaches said predetermined numerical value.

23. The defrost control system of claim 19, wherein said cooling device is energized by a source of electrical power, said defrost control including initializing means for initializing said count to said predetermined numerical value immediately following energization by said power source to initiate said defrost operation when said compressor run time reaches said minimum duration.

24. In a cooling system having a defrost device, a compressor, and a cooled compartment accessible through a door, a defrost control for energizing said defrost device, comprising:

compressor timing means for measuring the cumulative run time of said compressor;

door sensing means for detecting an initial open period of said door and a subsequent open period when said door is open beyond said intial open period;

control means for energizing said defrost device at the end of a variable interval determined at least partly by the entire door open period of the door, said control means including:

first advance means for advancing toward the end of said interval at an adaptably variable rate in response to said detected initial open period; and second advance means for advancing toward the end of said interval at a second rate in response to said detected subsequent open period;

de-energization means for ceasing energization of said defrost device after determining that a frost load has been removed;

defrost timing means for measuring the period of time said defrost device has been energized;

adaptive means for varying said adaptably variable rate in response to the measured time period of the defrost timing means;

inhibiting means for inhibiting energization of said defrost device until said compressor run time has reached a minimum value;

sensing means for sensing an abnormal operation condition; and adaptive disable means for disabling said adaptive means in response to said sensing means detecting said abnormal condition.

25. The defrost control of claim 24, wherein said adaptive means includes comparison means for comparing said measured time period of the defrost timing means against a desired time period to obtain a correction factor.

26. The defrost control of claim 25, wherein said adaptive means further includes varying means for varying said variable rate by a multiple of said correction factor.

27. The defrost control of claim 24, wherein said defrost control includes storage means for storing an initial value, and changing means for changing said initial value into a succession of intermediate values and a final value representing the end of said variable interval.

28. The defrost control of claim 27, wherein the sensing means includes indicating means for indicating when said initial value has been changed into said final value before said compressor run time has reached said minimum value.

29. The defrost control of claim 28, wherein said indicating means includes storage means for storing said indication until said compressor run time has reached said minimum value before said initial value has been changed into said final value.

30. The defrost control of claim 29, wherein said adaptive disable means includes means coupled to said storage means for disabling said adaptive means when said indication is stored.

31. The defrost control of claim 27, wherein said cooling device is energized by a source of power, said defrost control including initializing means for setting said initial value equal to said final value immediately following energization by said power source to energize said defrost device when said compressor run time has reached said minimum value.

32. In a cooling device having a defrost device and a cooled compartment accessible through a door, a method of energizing said defrost device at the end of an interval, comprising the steps of:

sensing the door to determine when said door is open, detecting an initial open period for said door and a subsequent open period when said door remains open beyond said initial open period, advancing toward the end of said interval at a first rate in response to said initial open period, and advancing toward the end of said interval at a second rate, different than the first rate, in response to said subsequent open period.

33. In a cooling device having a defrost device and a cooled compartment accessible through a door, a method of controlling said defrost device to remove a frost load, comprising the steps of:

sensing the door to determine when the door is open;

detecting an initial open period for said door and a subsequent open period when said door remains open beyond said initial open period;

advancing toward the end of an interval at a first rate in response to said initial open period;

advancing toward the end of said interval at a second rate different than the first rate in response to said subsequent open period;

energizing the defrost device at the end of the interval;

de-energizing the defrost device after the frost load has been removed;

measuring the length of time said defrost device was energized;

comparing the measured length of time against a desired defrost operation duration to obtain a correction factor; and varying the rate of advancement through the next interval in accordance with the correction factor.

34. The method of claim 33 in which the cooling device includes a compressor, comprising the further steps of measuring the compressor run time, and inhibiting the energization of said defrost device until said compression run time reaches a minimum value.

35. The method of claim 34, comprising the further step of preventing variation of the advancement through the next interval if the energization of said defrost device is inhibited.

36. The method of claim 34, comprising the further step of energizing the defrost device when said compressor run time reaches said minimum value immediately after said cooling device is energized.

* * * * *